US005901771A

United States Patent [19]

Williams, Jr.

[11] Patent Number: 5,901,771

[45] Date of Patent: May 11, 1999

[54] BLIND SYSTEM

[76] Inventor: Dalzel Williams, Jr., 5611 Halloway, Britton, Mich. 49229

[21] Appl. No.: 09/054,246

[22] Filed: Apr. 2, 1998

[51] Int. Cl.[6] ..... E06B 9/08

[52] U.S. Cl. ..... 160/133; 160/236

[58] Field of Search ..... 160/232, 235, 160/236, 133

[56] References Cited

U.S. PATENT DOCUMENTS

| | | | |
|---|---|---|---|
| 2,042,002 | 5/1936 | Hovey | 160/133 |
| 3,853,166 | 12/1974 | Wrono | 160/133 |
| 3,853,168 | 12/1974 | Wrono | 160/133 |
| 4,343,340 | 8/1982 | Paule | 160/232 |
| 4,690,193 | 9/1987 | Morrison et al. | 160/235 |
| 5,284,199 | 2/1994 | Finch et al. | 160/235 X |
| 5,474,118 | 12/1995 | Hoffman | 160/235 |

*Primary Examiner*—David M. Purol

[57] ABSTRACT

A shade system is provided including a spool assembly. Also included is a shade assembly having a set of first beams slidably connected to a set of second beams for allowing light to pass therethrough in a first orientation and precluding light to pass therethrough in a second orientation.

5 Claims, 3 Drawing Sheets

BLIND SYSTEM

BACKGROUND OF THE INVENTION

1. Field of the Invention

The present invention relates to venetian blinds and more particularly pertains to a new blind system for precluding the passage of light through a window with interconnected beams which are slidable with respect to each other.

2. Description of the Prior Art

The use of Venetian blinds is known in the prior art. More specifically, venetian blinds heretofore devised and utilized are known to consist basically of familiar, expected and obvious structural configurations, notwithstanding the myriad of designs encompassed by the crowded prior art which have been developed for the fulfillment of countless objectives and requirements.

Known prior art venetian blinds include U.S. Pat. No. 5,121,783; U.S. Pat. No. 4,940,070; U.S. Pat. No. 5,109,909; U.S. Pat. Des. 343,323; U.S. Pat. No. 4,292,763; and U.S. Pat. No. 4,732,201.

In these respects, the blind system according to the present invention substantially departs from the conventional concepts and designs of the prior art, and in so doing provides an apparatus primarily developed for the purpose of precluding the passage of light through a window with interconnected beams which are slidable with respect to each other.

SUMMARY OF THE INVENTION

In view of the foregoing disadvantages inherent in the known types of venetian blinds now present in the prior art, the present invention provides a new blind system construction wherein the same can be utilized for precluding the passage of light through a window with interconnected beams which are slidable with respect to each other.

The general purpose of the present invention, which will be described subsequently in greater detail, is to provide a new blind system apparatus and method which has many of the advantages of the venetian blinds mentioned heretofore and many novel features that result in a new blind system which is not anticipated, rendered obvious, suggested, or even implied by any of the prior art venetian blinds, either alone or in any combination thereof.

To attain this, the present invention generally comprises a spool assembly having an elongated housing mounted above a window of a structure. The housing is equipped with an elongated rectangular top face, front face and rear face. The housing further includes a pair of square side faces for defining an elongated rectangular open bottom. Note FIG. 6. The spool assembly further includes an elongated spindle of a first diameter. At least one disk of a second diameter greater than the first diameter is provided, as shown in FIG. 7. The disk is fixedly coupled to an end of the spindle in concentric relationship therewith. The ends of the spool assembly are rotatably coupled to the side faces of the housing within an interior space thereof. Connected to the disk is a draw string for selectively rotating the spindle. As shown in FIG. 7, a plurality of guides each have a generally C-shaped cross-section along an entire length thereof. The guides include a pair of vertical guides mounted to opposite side edges of the window. A bottom horizontal guide is mounted along a bottom edge of the window. It should be noted that the vertical guides and horizontal guide work together to define a peripheral slot. Next provided is a shade assembly mounted on the spindle and including a set of I-shaped beams. Each I-shaped beam has an I-shaped cross section along an entire length thereof. Further, each I-shape beam includes a pair of parallel horizontal plates with a vertical plate integrally coupled between central extents of the horizontal plates, a shown in FIG. 5. For reasons that will soon become apparent, the vertical plate of each I-shaped beam has a plurality of linearly aligned apertures formed therein. The shade assembly further includes a set of H-shaped beams each having an H-shaped cross-section along an entire length thereof. As shown in FIG. 5, each H-shaped beam includes a pair of parallel vertical plates and a horizontal plate integrally coupled between central extents of the vertical plates. An inwardly extending lip is integrally coupled to a terminal edge of each vertical plate of the H-beams for defining an upper and lower compartment. In use, the horizontal plates of each I-beam are slidably situated within a corresponding one of the compartments of an adjacent H-beam. Also, each of the beams has ends slidably situated within the vertical guides. It should be noted that a bottommost one of the beams is situated within the horizontal guide.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new blind system apparatus and method which has many of the advantages of the venetian blinds mentioned heretofore and many novel features that result in a new blind system which is not anticipated, rendered obvious, suggested, or even implied by any of the prior art venetian blinds, either alone or in any combination thereof.

It is another object of the present invention to provide a new blind system which may be easily and efficiently manufactured and marketed.

It is a further object of the present invention to provide a new blind system which is of a durable and reliable construction.

An even further object of the present invention is to provide a new blind system which is susceptible of a low cost of manufacture with regard to both materials and labor, and which accordingly is then susceptible of low prices of sale to the consuming public, thereby making such blind system economically available to the buying public.

Still yet another object of the present invention is to provide a new blind system which provides in the apparatuses and methods of the prior art some of the advantages thereof, while simultaneously overcoming some of the disadvantages normally associated therewith.

Still another object of the present invention is to provide a new blind system for selectively precluding the passage of light through a window with interconnected beams which are slidable with respect to each other.

Even still another object of the present invention is to provide a new blind system that includes a spool assembly. Also included is a shade assembly having a set of first beams slidably connected to a set of second beams for allowing light to pass therethrough in a first orientation and precluding light to pass therethrough in a second orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
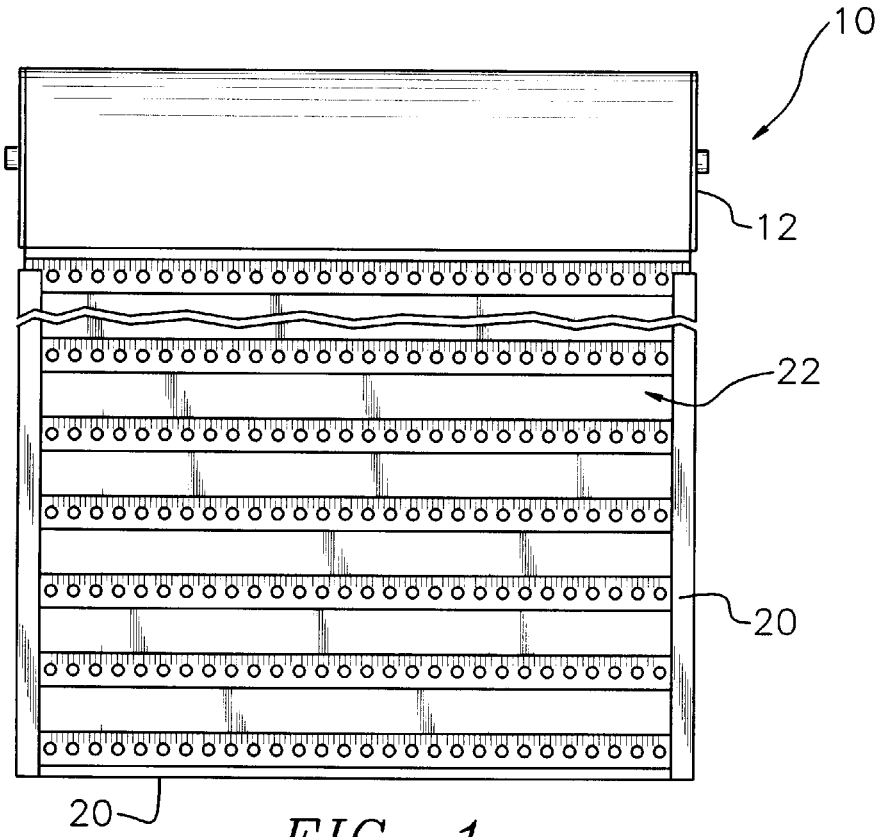
FIG. 1 is a front view of a new blind system according to the present invention.
Figure 2:
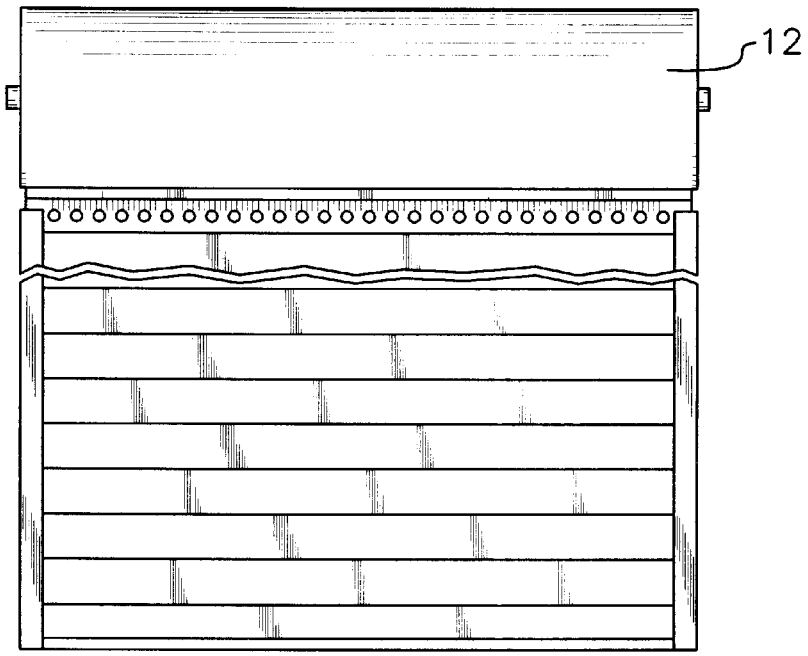
FIG. 2 is a front view of the present invention with the beams is a partially closed orientation.

With reference now to the drawings, and in particular to FIGS. 1 through 7 thereof, a new blind system embodying the principles and concepts of the present invention and generally designated by the reference numeral 10 will be described.

The present invention, designated as numeral 10, includes a spool assembly 14 having an elongated housing 12 mounted above a window of a structure. The housing is equipped with an elongated rectangular top face, front face and rear face. The housing further includes a pair of square side faces for defining an elongated rectangular open bottom. Note FIG. 6.

Figure 7:
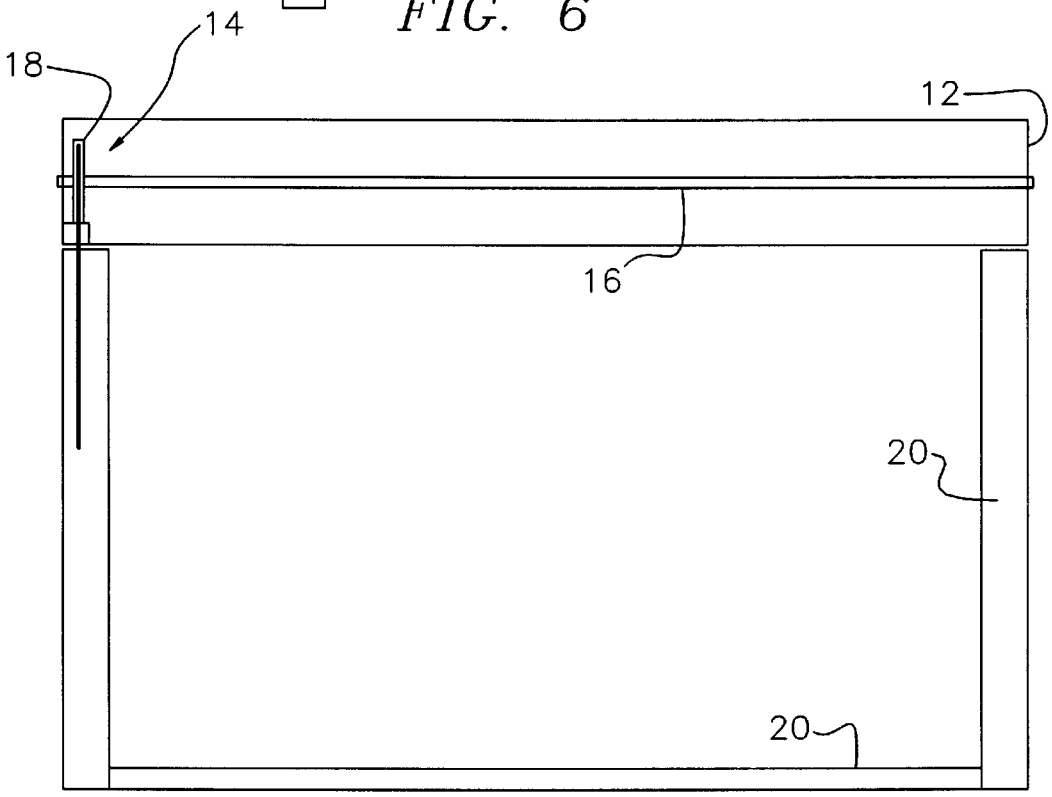
FIG. 7 is a front view of the spool assembly and guides of the present invention.

The spool assembly 14 further includes an elongated spindle 16 of a first diameter. At least one disk 18 of a second diameter greater than the first diameter is provided, as shown in FIG. 7. Such disk is fixedly coupled to an end of the spindle in concentric relationship therewith. Further, the ends of the spool assembly are rotatably coupled to the side faces of the housing within an interior space thereof by way of nylon bushings. Connected to the disk is a draw string 19 for selectively rotating the spindle. Associated therewith is conventional draw string stop, as shown in FIG. 7.

As shown in FIG. 7, a plurality of guides 20 each have a generally C-shaped cross-section along an entire length thereof. The guides include a pair of vertical guides mounted to opposite side edges of the window. A bottom horizontal guide is mounted along a bottom edge of the window. It should be noted that the vertical guides and horizontal guide work together to define a peripheral slot. In the preferred embodiment, the guides are mounted to a recipient surface by way of screws or the like.

Next provided is a shade assembly 22 mounted on the spindle and including a set of I-shaped beams 24. Each I-shaped beam has an I-shaped cross section along an entire length thereof. Further, each I-shape beam includes a pair of parallel horizontal plates 26 with a vertical plate 28 integrally coupled between central extents of the horizontal plates, a shown in FIG. 5. For reasons that will soon become apparent, the vertical plate of each I-shaped beam has a plurality of linearly aligned apertures 29 formed therein along an entire length thereof.

Figure 5:
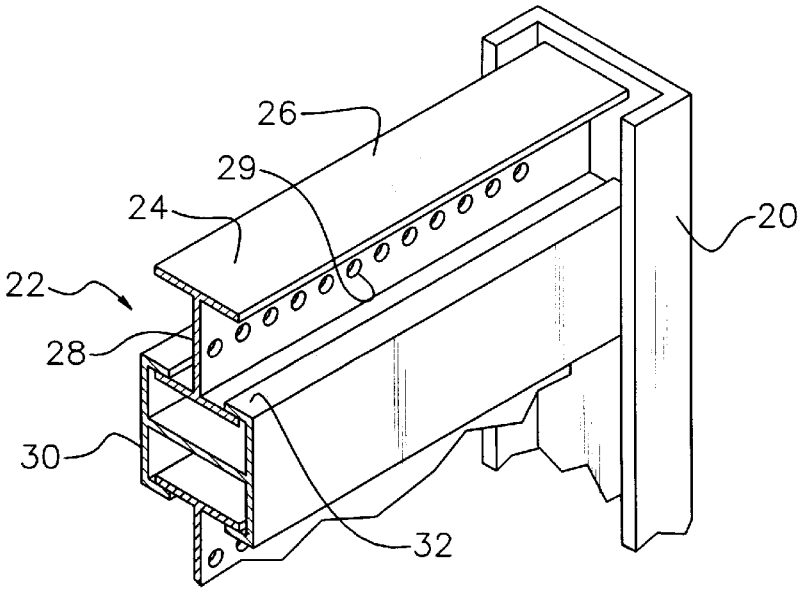
FIG. 5 is a perspective view of the interconnection of the beams of the present invention.
Figure 6:
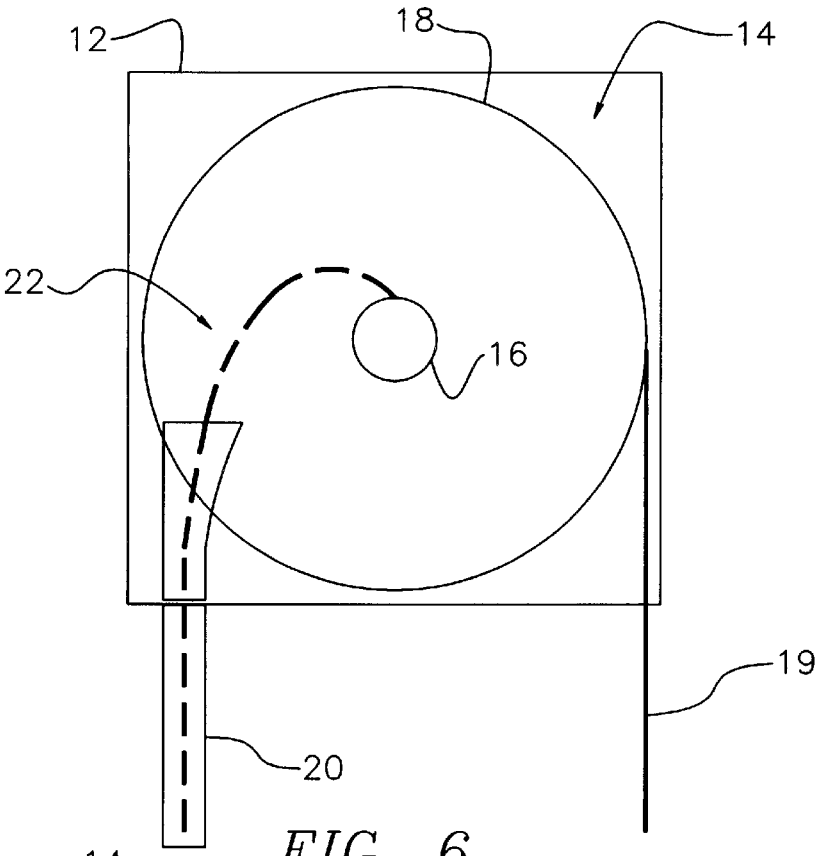
FIG. 6 is a side view of the spool assembly of the present invention.

The shade assembly further includes a set of H-shaped beams 30 each having an H-shaped cross-section along an entire length thereof. As shown in FIG. 5, each H-shaped beam includes a pair of parallel vertical plates and a horizontal plate integrally coupled between central extents of the vertical plates. An inwardly extending lip 32 is integrally coupled to a terminal edge of each vertical plate of the H-beams for defining an upper and lower compartment. Ideally, a height of the upper and lower compartment, together, equal a height of the vertical plate of the associated I-beam.

In use, the horizontal plates of each I-beam are slidably situated within a corresponding one of the compartments of an adjacent H-beam. Also, each of the beams has ends slidably situated within the vertical guides. It should be noted that a bottommost one of the beams is situated within the horizontal guide.

Figure 3:
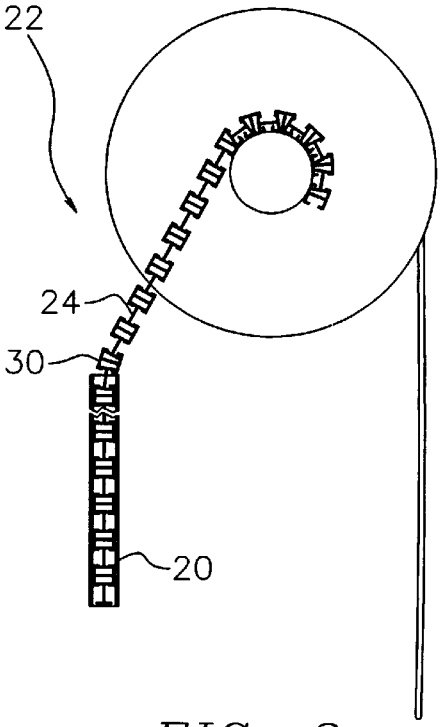
FIG. 3 is a side view of the present invention with the beams in an open orientation.
Figure 4:
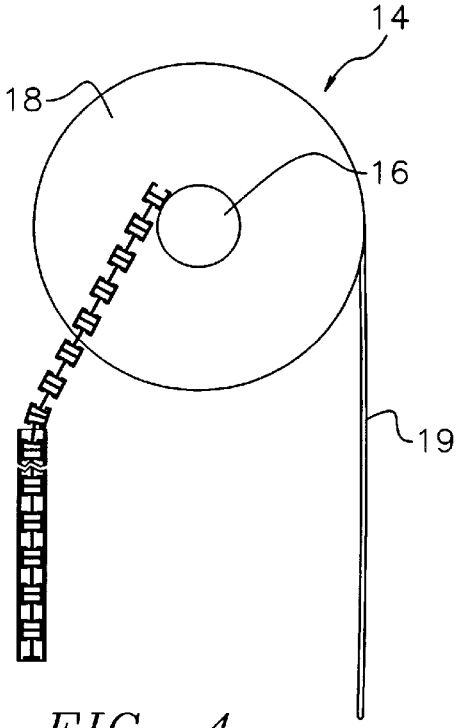
FIG. 4 is a side view of the present invention with the beams in a closed orientation.

As shown in FIGS. 3 & 4, the vertical plates of the I-shaped beams are maintained within the compartments of the associated H-shaped beams upon the rotation of the spindle of the spool assembly in a first direction. In such orientation, the beams serve for precluding light from passing therethrough. Note FIG. 4. Upon the rotation of the spindle of the spool assembly in a second direction, the vertical plates of the I-shaped beams are extended from the compartments of the associated H-shaped beams. This is for allowing light to pass through the apertures thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shade assembly comprising, in combination:

a spool assembly including an elongated housing mounted above a window of a structure with an elongated rectangular top face, front face and rear face, the housing further including a pair of square side faces for defining an elongated rectangular open bottom, the spool assembly further including an elongated spindle of a first diameter and at least one disk of a second diameter greater than the first diameter fixedly coupled to ends of the spindle in concentric relationship therewith, ends of the spool assembly rotatably coupled to the side faces of the housing within an interior space thereof, wherein a draw string is connected to the disk for selectively rotating the spindle;

a plurality of guides each having a generally C-shaped cross-section along an entire length thereof, the guides including a pair of vertical guides mounted to opposite side edges of the window and a bottom horizontal guide mounted along a bottom edge of the window, wherein the vertical guides and horizontal guide work together to define a peripheral slot; and a shade assembly mounted on the spindle and including a set of I-shaped beams each having an I-shaped cross section along an entire length thereof, each I-shape beam having a pair of parallel horizontal plates with a vertical plate integrally coupled between central extents of the horizontal plates, the vertical plate of each I-shaped beam having a plurality of linearly aligned apertures formed therein, the shade assembly further including a set of H-shaped beams each having an H-shaped cross-section along an entire length thereof, each H-shaped beam having a pair of parallel vertical plates, a horizontal plate integrally coupled between central extents of the vertical plates and an inwardly extending lip integrally coupled to a terminal edge of each vertical plate of the H-beams for defining an upper and lower compartment, wherein the horizontal plates of each I-beam are slidably situated within a corresponding one of the compartments of an adjacent H-beam and each of the beams has ends slidably situated within the vertical guides;

whereby the vertical plates of the I-shaped beams are maintained within the compartments of the associated H-shaped beams upon the rotation of the spindle of the spool assembly in a first direction for precluding light from passing therethrough and further the vertical plates of the I-shaped beams are extended from the compartments of the associated H-shaped beams upon the rotation of the spindle of the spool assembly in a second direction for allowing light to pass through the apertures thereof.

2. A shade system comprising:

a spool assembly; and a shade assembly including a set of first beams slidably connected to a set of second beams for allowing light to pass therethrough in a first orientation and precluding light to pass therethrough in a second orientation;

wherein the first beams each have a substantially I-shaped cross-section;

wherein the second beams have a substantially H-shaped cross-section and are defined by a pair of vertical plates each with inwardly extending lips integrally formed on each of a pair of terminal edges thereof;

wherein at least one of the first beams and second beams has at least one opening formed therein for allowing the passage of light and at least one of the first beams and second beams serves to cover the opening in the second orientation.

3. A shade system as set forth in claim 2 wherein the beams constantly remain in front of an associated window.

4. A shade system as set forth in claim 2 and further including a guide mounted adjacent to a window associated with the shade assembly for slidably receiving ends of the beams.

5. A shade system as set forth in claim 2 and further including a horizontal guide for receiving a bottommost one of the beams.

* * * * *